US008360813B1

(12) United States Patent
Alvarez

(10) Patent No.: US 8,360,813 B1
(45) Date of Patent: Jan. 29, 2013

(54) RESCUE POLE AND CLAMPING ASSEMBLY

(76) Inventor: Arthur Alvarez, Birchwood, WI (US)

( * ) Notice: Subject to any disclaimer, the term of this patent is extended or adjusted under 35 U.S.C. 154(b) by 0 days.

(21) Appl. No.: 13/533,252

(22) Filed: Jun. 26, 2012

(51) Int. Cl.
*B63C 9/00* (2006.01)

(52) U.S. Cl. ..... 441/80; 114/221 R

(58) Field of Classification Search ..... 114/221 R; 441/80; 294/107, 191, 210, 211, 209; 43/5, 43/801, 806, 807; 119/801.806
See application file for complete search history.

(56) References Cited

U.S. PATENT DOCUMENTS

| | | | | |
|---|---|---|---|---|
| 409,478 | A * | 8/1889 | Lucky | 294/107 |
| 1,002,709 | A | 9/1911 | Kromann | |
| 1,056,343 | A | 3/1913 | Kromann | |
| 2,122,264 | A | 6/1938 | Porter | |
| 2,485,703 | A | 10/1949 | Christoffer | |
| 3,841,685 | A | 10/1974 | Kolodziej | |
| 3,978,605 | A | 9/1976 | Maruniak | |
| 4,519,643 | A | 5/1985 | Harris | |
| 4,580,825 | A | 4/1986 | Johnson | |
| 4,599,074 | A | 7/1986 | Beckly | |
| 4,845,876 | A | 7/1989 | Dodson | |
| 5,003,907 | A | 4/1991 | Roach et al. | |
| 5,058,306 | A * | 10/1991 | Sienel | 43/5 |
| 5,116,093 | A | 5/1992 | Burns | |
| 5,494,240 | A | 2/1996 | Waugh | |
| 5,752,731 | A | 5/1998 | Crone | |
| 5,799,602 | A | 9/1998 | Trillo | |
| 6,067,942 | A | 5/2000 | Fernandez | |
| 7,029,353 | B2 | 4/2006 | Goodman et al. | |
| 7,246,575 | B2 | 7/2007 | Goto | |

* cited by examiner

*Primary Examiner* — Edwin Swinehart
(74) *Attorney, Agent, or Firm* — Tipton L Randall

(57) ABSTRACT

A rescue pole is secured to a clamping mechanism having a hollow body with exterior sections connected by sidewalls. A pair of opposed curved arms extends from the hollow body. Each arm has a pin extending through a pair of aligned, linear slots in the hollow body, with the slots converging toward the pole. A drive mechanism within the body member is pivotally secured to each curved arm. A pulley is mounted on the body between the curved arms opposite the pole. First and second rope members secured to the drive mechanism operate the curved arms. Pulling the first rope through the pulley moves apart the exterior attached arms. Pulling the second rope through the hollow body moves together the exterior attached arms.

20 Claims, 8 Drawing Sheets

RESCUE POLE AND CLAMPING ASSEMBLY

CROSS-REFERENCE TO RELATED APPLICATIONS, IF ANY

Not applicable.

STATEMENT REGARDING FEDERALLY SPONSORED RESEARCH OR DEVELOPMENT

Not applicable.

REFERENCE TO A MICROFICHE APPENDIX, IF ANY

Not applicable.

BACKGROUND OF THE INVENTION

1. Field of the Invention

The present invention relates to a rescue pole device and, more particularly, to a rescue pole device having a clamping end and, most particularly, to a rescue pole and clamp device useful for rescuing and individual that is in the water or has fallen through the ice into water.

2. Background Information

When an individual has fallen in the water and is in need of assistance to be rescued, a number of devices are available to assist rescuers in this task. In warmer climates, a wide variety of rescue devices can be employed, including a simple pole, a ring buoy on a rope, a life vest, a nearby boat or canoe, etc. The situation is more complex in cold climates where the water is much colder and may be covered by ice. Although the danger of drowning is present in both situations, an individual in icy water must contend with hypothermia as well. In warmer water situations, the individual may be able to assist rescuers in moving the individual to safety. An individual subjected to icy water quickly loses the ability to work with rescuers to aid in their transport to safety. Consequently, a device for icy water rescues must be able to engage an individual in distress without that individual's assistance. Such a situation often occurs when an individual has fallen through thin ice on a body of water. In this situation, the rescuer dare not closely approach the individual in distress, lest the rescuer also break through the ice. A number of devices having a feature for engaging an individual, an animal or an object have been granted patents.

Kromann, in U.S. Pat. No. 1,002,709, describes a spring-loaded harpoon device having a pair of arms with curved ends. The arms are pivotally anchored at one end to a handle and each anchored end has gear teeth, which engage a toothed shaft. A spring around the handle moves the shaft out from the handle with the shaft, which pivots the anchored ends of the arms. This pivoting causes the curved ends of the arms to converge and encircle or impale an object.

In U.S. Pat. No. 1,056,343, Kromann discloses another spring-loaded harpoon device having a pair of scissors arms with curved ends. Actuating the device causes the scissors arms to extend and the curved ends to close on an object and impale or securely hold the object with the curved ends of the scissors arms.

Porter, in U.S. Pat. No. 2,122,264, describes a noose device that includes a long and slender body part with the animal-engaging section at one end and the manipulating and extension-connecting section at its opposite end. The opposite end is held by the operator, and the engaging section includes a mechanism to open for admittance of the animal and close for its retention. The animal-engaging section is made up of hollow curved fork members rigidly secured to the end of the body part, which also is hollow, and curved closure members are slidable inward and outward in the hollow fork members. The fork members have on their outer ends ball-like enlarged projections, which are adapted for avoiding injury to the animal as they pass at opposite sides of its neck or body. The closure members slide to their inner positions in the respective fork members, and then pass around the neck or body of the animal to their outer closing positions. The closure members also are hollow, with the terminal balls fixed by necks inside their outer ends and provide the outer-end-abutments for respective open-coil springs contained within the closure members. These springs are compressed between the outer and inner abutments when the closure members are moved inward, and tend to force these members outward to the closing position unless held by retaining means. The retaining means comprises slender but strong cables with their outer end parts fixed in the necks of the respective ball terminals.

In U.S. Pat. No. 2,485,703, Christoffer discloses an improved livestock tool that includes a body having clamp arms pivoted on the lower end thereof, and adapted to support a cable loop. The body contains a handle operatively connected with the clamp arms for automatically moving the clamp arms to tighten the cable loop about the snout of the animal when caught. The loop is removable so that the tool may be used as a bull stop or cattle leader by engaging the clamp arms in the nostrils of the animal or in a ring already in the animal's nose.

Kolodziej, in U.S. Pat. No. 3,841,685, describes a line holding and manipulating device that includes a pair of flexible arms, which define arcs of the same radii and of less than 180° length. The flexible arms describe a circle having a gap between oppositely disposed ends of the arms. The arms are hollow in nature, are slotted along their entire length and are supported in such a manner as to cause the slots to face inwardly toward the center of the circle. A loop at the end of a line may be supported within the hollow flexible arms prior to engagement with an object.

In U.S. Pat. No. 3,978,605, Maruniak discloses a cheliform fish grip having an overall specific gravity of less than that of water. The device is obtained by constructing the parts of a plastic having a specific gravity greater than 1.0, and constructing the handle with an air compartment of sufficient size to reduce the overall specific gravity to less than 1.0. The jaws of the fish grip are pivotally mounted on a body, an actuator is slidably mounted in the body and spring biased levers are pivotally connected to the actuator and to a central portion of each jaw.

Harris, in U.S. Pat. No. 4,519,643, describes a rope handling device comprising two cylindrical tubes adapted to have one pass longitudinally within the other, with a T or Y shaped journal attached to the end of the outer tube. An appropriate length of rope is positioned through the length of the inner tube and the rope is looped at the end extending out of the tubes and through a spreading journal or yoke. One portion of the loop extends out one side of the journal, and another part extends out the other side of the journal, and the completion of the loop extends out beyond the journal. The loop section of the rope has a stiffening means, such as a stiff spring wire embedded and securely fastened in the rope. The loop may be enlarged by pushing the rope through the spreader. The loop may be made smaller and tightened on any object encircled by the loop by pulling the rope through the tubes. By pulling the inner tube away from the loop, the overall length of tubes may be expanded to a considerable length to permit positioning the loop over an object a considerable distance from the holder.

The device is particularly adapted for fastening boats to mooring posts.

In U.S. Pat. No. 4,580,825, Johnson discloses an apparatus for extricating an individual from a hazardous location or situation. The apparatus includes a mechanism for selectively grappling various portions of the individual's body and a generally elongated frame having a substantially longitudinal extent which can be varied in length and which supports the body grappling mechanism. The elongated frame allows an individual to use the grappling mechanism to grapple a portion of the body of the individual who is in a jeopardized situation from a position of safety without jeopardizing both individuals. The body grappling mechanism includes a torso engaging mechanism and a limb engaging mechanism, both of which extend outwardly from the longitudinal axis of the frame of the apparatus. The torso engaging mechanism is contoured to define at least one torso receiving concavity having a lateral extent, with respect to the frame, which is selectively sized and configured to receive and retain the torso of an average individual. The limb engaging mechanism is contoured to define at least one limb receiving concavity having a lateral extent, with respect to the frame, which is selectively sized and configured to receive and retain at least one limb of an average individual. The lateral extent of the limb receiving concavity is less than the lateral extent of the torso receiving concavity. Depending upon the hazardous situation in which the apparatus is to be utilized, the entire apparatus may be formed from electrically insulating materials and/or chemically resistant materials.

Beckly, in U.S. Pat. No. 4,599,074, describes a man-overboard retrieval device that includes a rigid, tubular boom attachable at an inboard end to an anchorage on a boat. At its other, outboard end, a strap forms a semi-rigid, self-supporting bight, which can be placed around a man in the water. A draw-cord attached to a free end of the strap extends through the boom and emerges at the inboard end where it can be pulled to tighten the bight around the man before being fastened in a cleat. A hoist on the boat can be attached to a hoisting eye on the boom either at the inboard end or near the strap, as convenient, for hoisting the device and the rescued man onboard.

In U.S. Pat. No. 4,845,876, Dodson discloses a self-activated gaff, which responds to contact of a trigger bar with an object to cause a pair of tongs to close and embrace the object and to lock around the object until released. The gaff uses a piston-like member and a pair of constant force springs to couple the piston-like member to the tongs. The tongs may subsequently be released by the manual release of the tong-locking mechanism.

Roach et al., in U.S. Pat. No. 5,003,907, describe a mooring and maneuvering device, which includes an elongated rigid pole, having an improved boat hook at the distal end. A flexible loop is attached at the distal end and moves to an operative position to facilitate the securing of the device to a mooring post. In an inoperative position, the loop is pivoted back upon and secured to the pole to permit the use of the device for other purposes.

In U.S. Pat. No. 5,116,093, Burns discloses an apparatus for moving an individual. The apparatus includes a fitting attached to one end of a pole. The fitting is shaped and dimensioned to engage an individual's clothing by being pressed against the clothing and rotated. The apparatus can be fitted with various hooks and/or straps to engage the appendages or body of an individual in need of rescue.

Waugh, in U.S. Pat. No. 5,494,240 describes a recovery device for use from the cargo door of a helicopter hovering over a vehicle to be recovered. The device includes a telescoping pole with an upper end secured to the helicopter floor and a lower end defining a hoop which can be manipulated around the weapon or target into a first position for securing a first noose to a first portion of the vehicle to be recovered. The snare pole is then shifted to a second position where a second noose is tightened around a second portion of the vehicle. After the nooses have been positioned about the vehicle, the crewman aboard the helicopter pulls the retainer lanyard joined to the retaining pins. This operation releases the snare pole from the helicopter. The inner pole telescopes within the outer pole, and the vehicle is held directly beneath the helicopter by the cargo hook. The pilot can then fly the helicopter upwardly to carry the vehicle clear of the water.

In U.S. Pat. No. 5,752,731, Crone discloses victim snare pole that includes a substantially stiff, elongated member having two opposing ends, on at least one end of which are provided a rearward facing hook and a non-sliding snare loop. Other feature(s) such as light(s) may be provided. In a preferred embodiment, the pole is substantially non-reactive with respect to the victim and the surrounding area where a rescue would be attempted. A victim may be rescued by a rescue operator by steps, which can include providing the victim snare pole to the rescue operator, and locating the victim; inspecting the victim and his surroundings, and discerning how to rescue him with the victim snare pole. The actions are selected of; hooking and pulling the victim back in the direction of the rescue operator employing the hook of the pole; securing the victim with the non-sliding snare loop by causing the non-sliding snare loop to surround a part of the victim; followed by twisting the victim snare pole to tighten the non-sliding snare loop around that part of the victim and then pulling him back in the direction of the rescue operator.

Trillo, in U.S. Pat. No. 5,799,602, describes a docking fork for facilitating the placing of a docking line loop about an object, such as a piling or cleat, to assist in the docking of a marine vessel. The docking fork includes a substantially U-shaped tray member defining upstanding walls and a floor for receiving and maintaining a docking line loop in an open condition in preparation for positioning about the object. The docking fork, supporting the docking line loop, is placed over a piling and is pulled away, thus leaving the docking line loop alone about the object in preparation for tightening and subsequent docking of the vessel.

In U.S. Pat. No. 6,067,942, Fernandez discloses a device for capturing an aquatic animal, such as a fish, particularly for ensnaring the tail or body of a fish. The invention relates to a device, which places a rope around the body or tail of any fish. The device comprises a pole having a circular tube attached at one end of the pole. A rope is removably attached to the inside of the tube such that when the rope is pulled on, it is removed from the attachments of the tube and ensnares the body or tail of the fish. The rope has an open end on one end and a noose at the other end.

U.S. Pat. No. 7,029,353 by Goodman et al. discloses a system and method involving a line capture device and a flotation apparatus. The line capture device has a body, at least one line retainer having a line retainer portion and a latching portion for retaining a portion of a captured line. A capturing line extends from the body for pulling the device. The captured line and a secondary object, such as a victim, can be pulled back to a rescuer. The flotation apparatus has a safety flotation vest housing a deployable flotation device and a deployable line to be captured.

Goto, in U.S. Pat. No. 7,246,575, describes a thrust fork to arrest a resisting criminal without danger of being stabbed by an edge tool. A thrust fork's main body is attached to an end of a handle portion provided with a forked rod. Movable opening and closing rods have base end portions pivoted to leading ends of the forked rod and freely swivel only inside the forked rod without outward movement. A returning element returns the opening and closing rods by a spring to an original position. A constraining rope, both ends of which are engaged with leading ends of the opening and closing rods respectively, forms a ring having a suitable size inside the forked rod. The end of the forked rod is opened and closed via swiveling of the opening and closing rods.

Applicant has invented a rescue pole and clamping device that overcomes the short comings of these patent inventions.

SUMMARY OF THE INVENTION

The invention is directed to a rescue pole with a clamping assembly at one end. The rescue pole is telescoping in structure and extends to a length of at least about 24 feet. At one end of the pole is mounted a clamping mechanism that is designed to encircle and grasp the body of an individual, particularly an individual that has broken through the ice and requires rescue. The clamping mechanism includes a pair of curved arm members each with an attachment section at one end. Each attachment section is pivotally secured at one end to a drive mechanism slidably positioned within a body member, which is rigidly mounted to the end of the telescoping pole member. A guide pin is positioned on the attachment section of each curved arm member, and each guide pin is movably positioned within both of a pair of aligned slots in the body member. The slots converge in the direction of the attached pole member. The body member includes a roller or pulley at an edge opposite the pole member. A pair of ropes or cables is attached to the drive mechanism and extends the full length of the extended pole member. A first rope member is attached to the drive member and loops around the roller or pulley on the body member, and extends back down the pole member. A second rope member is attached to the drive mechanism and extends within the body member, directly back down the pole member. The curved arm members and the end portion of the body member include flotation coverings, such as Styrofoam® or similar buoyant material, to float the clamping assembly on the surface of the water.

In use, the telescoping pole member is extended fully and is used to manipulate the clamping end of the assembly to an individual in the water. Pulling on the second rope member, the drive mechanism moves toward the pole member with the guide pins traveling toward each other within the slots of the guide plate member. This movement causes the curved arm members to pivot about the guide pin members and close around the torso of the individual in the water. Then the second rope member is used to pull the individual to safety, while the telescoping pole is used only to position the clamping mechanism. Should the individual slip from the grasp of the curved arm members, the arm members can be reopened wide by pulling on the first rope member. The first rope member, which is looped around the roller or pulley of the body member, reopens the curved arm members for another attempt to grasp the torso of the individual.

DESCRIPTION OF THE EMBODIMENTS

Nomenclature

10 Rescue Pole with Clamping Assembly
15 Linear Pole Member
17 Telescoping Sections of Pole Member
18 Pole Member Connector
20 Clamping Mechanism
25 Body Member of Clamping Mechanism
30 Opposed Planar Sections
32 Sidewall Sections
34 Pole Connector Member
36 Aligned Linear Slots of Opposed Planar Sections
38 Pulley Member
40 Curved Arm Members
42 Attachment End of Arm Members
44 Curved End of Arm Members
46 Pin Member of Arm Members
50 Drive Mechanism of Clamping Assembly
52 First Pair of Pivoting Arms
53*a* First End of First Pair of Arm Members
53*b* Second End of First Pair of Arm Members
54 Second Pair of Pivoting Arms
55*a* First End of Second Pair of Arm Members
55*b* Second End of Second Pair of Arm Members
56 Pivot Point Connectors Pins
58 Flexible Link
60 First Rope Member
65 Second Rope Member
70 Interior Partition of Body Member
80 Flotation Member of Arm Members
85 Flotation Member of Body Member Construction The invention is a rescue pole with clamping assembly comprising a linear pole member secured at one end to a clamping mechanism. The clamping mechanism includes a body member having opposed planar sections in register connected by sidewall sections to form a hollow interior. A pole connector member is positioned at one edge of the body member, with the pole connector member attached to said end of the linear pole member. A pair of opposed curved arm members extends from interior the hollow body member. Each arm member includes a pin member positioned interior the hollow body member. Each pin member extends through both of a pair of aligned, linear slots in the opposed planar sections of the body member, with each pair of aligned slots converging toward the pole connector member. A drive mechanism within the hollow body member is pivotally secured to an attachment end of each curved arm member there within. A pulley member is rotatably mounted at an edge of the hollow body member opposite the pole connector member and between the pair of opposed curved arm members. First and second rope members are each secured to the drive mechanism. The first rope member encircles the pulley member and extends from the body member. The second rope member extends from interior the body member directly from the drive mechanism and adjacent the pole connector member. Pulling the first rope member draws the drive mechanism and attachment end of each curved arm member toward the pulley member with the pin members in the linear slots moving to spread apart the attached arm members exterior the body member. Pulling the second rope member draws the drive mechanism and attachment end of each curved arm member toward the pole connector member, with the pin members in the linear slots moving to bring together the attached arm members exterior the body member.

Figure 1:
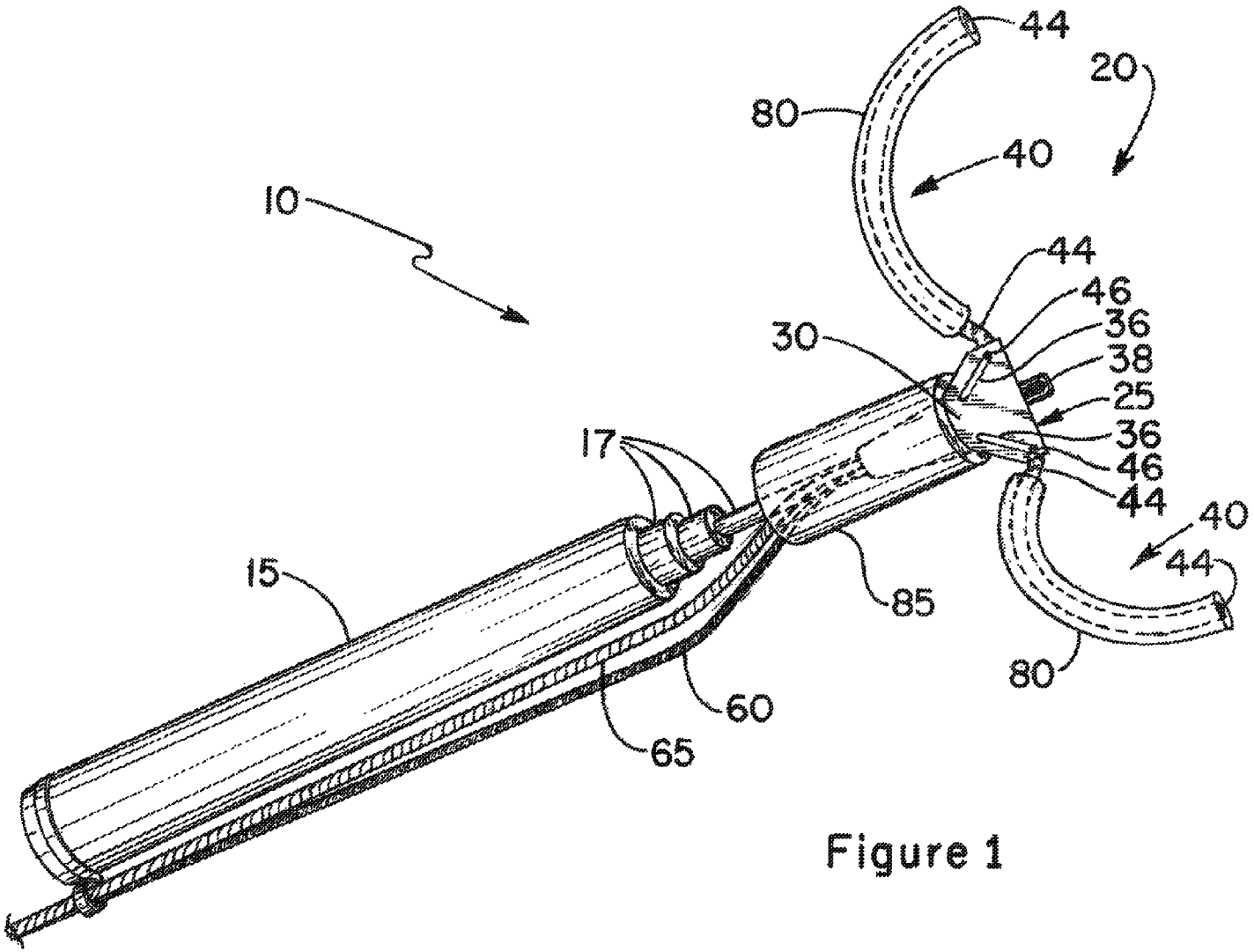
FIG. 1 is a perspective view of the rescue pole with clamping mechanism of the present invention with the clamping mechanism is an open condition.
Figure 2:
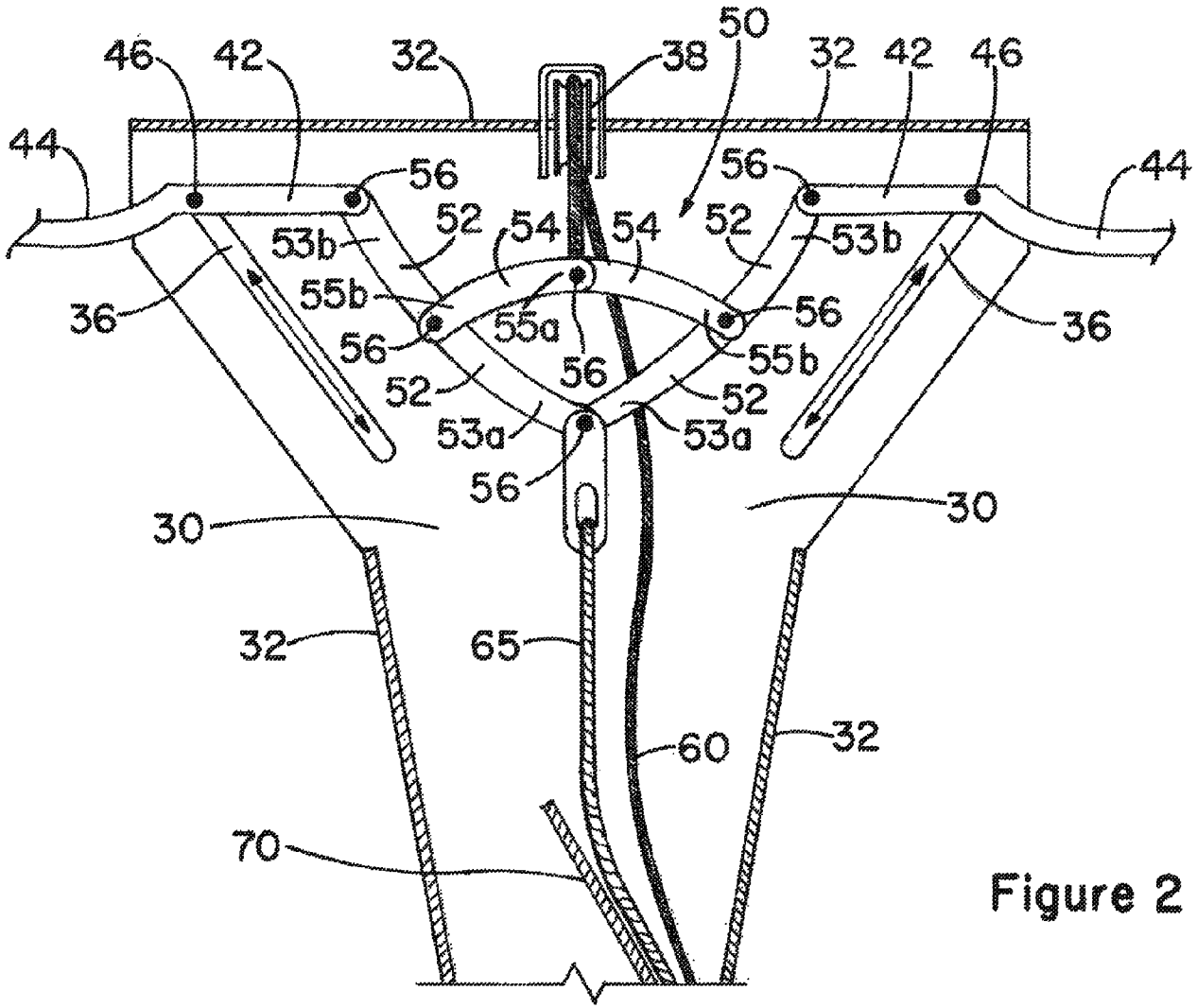
FIG. 2 is a top view of a part of the clamping mechanism portion of the present invention in an open condition with one planar portion of the body member removed.
Figure 6:
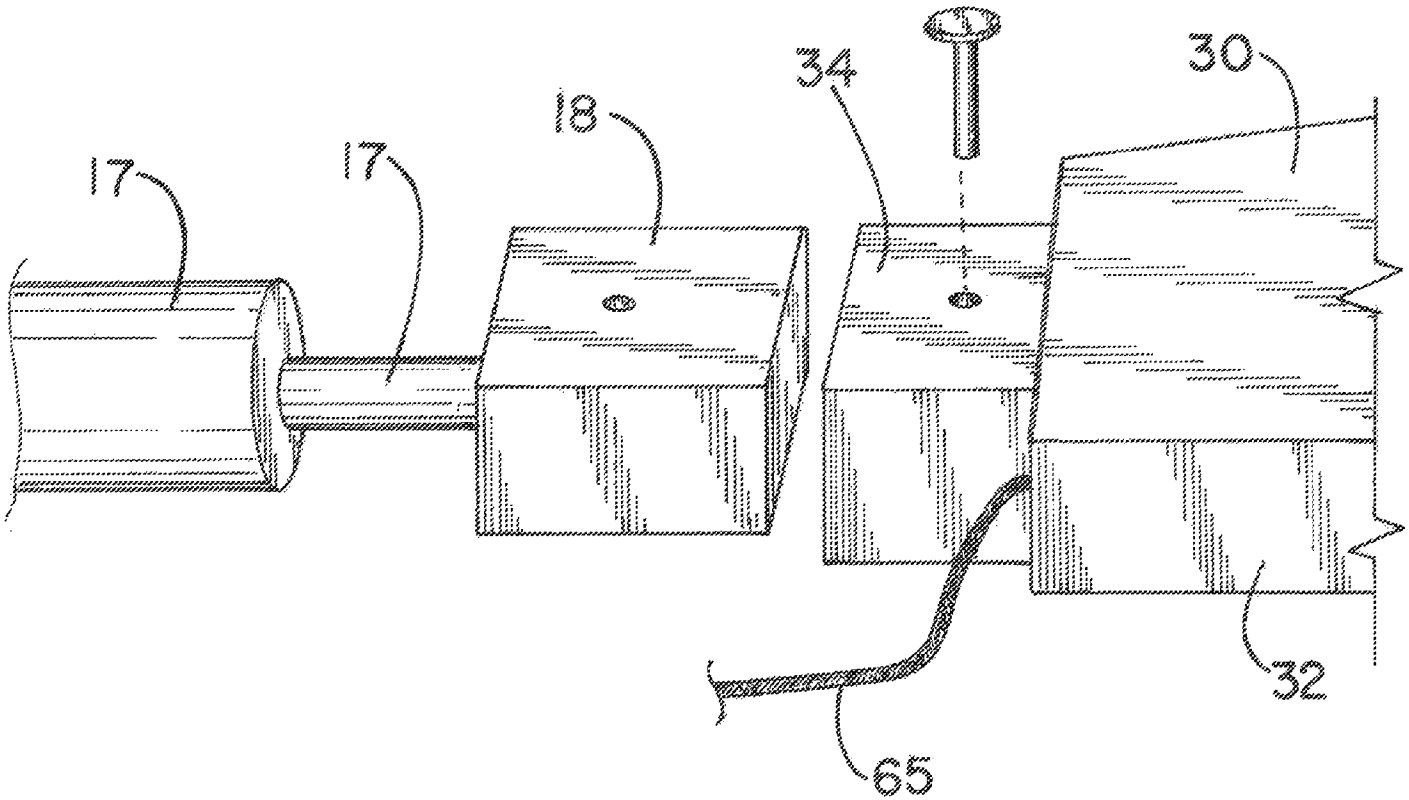
FIG. 6 is a perspective view of a portion of the rescue pole and the pole connector member of the present invention.

Referring now to FIGS. 1 and 2, a first embodiment of the rescue pole with clamping assembly 10 is shown. The rescue pole with clamping assembly 10 comprising a linear pole member 15 secured at one end by a connector 18 to a clamping mechanism 20. Preferable the linear pole member 15 is telescoping and fabricated with telescoping sections 17 to allow lengthening of the pole member 15 as needed. The clamping mechanism 20 includes a body member 25 having opposed planar sections 30 positioned in register and connected by sidewall sections 32 to form a hollow interior. The sidewall sections 32 are not continuous, thereby providing several openings into the hollow interior. A plan view of the body member 25 with one of the planar sections 30 removed is shown in FIG. 2. A pole connector member 34 is positioned at one edge of the body member 25, with the pole connector member 34 attached to the connector 18 at the end of the linear pole member 15, as illustrated in FIG. 6.

A pair of opposed curved arm members 40 extend from interior the hollow body member 25. The sidewall sections 32 of the body member 25 are not continuous and provide openings in the body member 25 for movement of the curved arm members 40. Each arm member 40 includes an attachment end 42 positioned interior the body member 25 and a curved end 44 positioned exterior the body member 25. Preferably, the curved end 44 of each arm member 40 is encircled by a tight fitting flotation member 80 that is both buoyant and structurally strong. A suitable material for the flotation members 80 is a polystyrene polymer foam in a cylindrical form. Each arm member 40 includes a pin member 46 in the attachment end 42 that also is positioned interior the hollow body member 25. Each pin member 46 extends through a pair of aligned, linear slots 36 each slot in one of the opposed planar sections 30 of the body member 25, with each pair of aligned slots 36 converging toward the pole connector member 34.

A drive mechanism 50 within the hollow body member 25 is pivotally secured to the attachment end 42 of each curved arm member 40 there within. As shown in FIG. 2, the drive mechanism 50 comprises a pair of first pivoting arms 52 pivotally joined together at each first end 53*a* by a pivot point connector pin 56. Each first pivoting arm 52 is pivotally connected at a second end 53*b* to the attachment end 42 of one curved arm member 40 at a point interior to the pin member 46. Another pivot point connector pin 56 provides the connection. In addition, a pair of second pivoting arms 54 is pivotally joined together at each first end 55*a* by another pivot point connector pin 56. Each second arm 54 is pivotally connected at a second end 55*b* to a midpoint of one of the pair of first arms 52, again by another pivot point connector pin 56.

A pulley member 38 is rotatably mounted at an edge of the hollow body member 25 opposite the pole connector member 34 and between the pair of opposed curved arm members 40. A first rope member 60 is secured to the drive mechanism 50 at the pivot point connector pin 56 connecting the first ends 55*a* of the pair of second pivoting arms 54. The first rope member 60 encircles the pulley member 38 and extends from the body member 25. A second rope member 65 is also secured to the drive mechanism 50, but at the pivot point connector pin 56 connecting the first ends 53*a* of the pair of first pivoting arms 52. The second rope member 65 extends from interior the body member 25 directly from the drive mechanism 50 and outside the body member 25 adjacent the pole connector member 34, as illustrated in FIG. 6.

Pulling the first rope member 60 draws the drive mechanism 50 and the attachment end 42 of each arm member 40 toward the pulley member 38 with the pin members 46 in the linear slots 36 moving to spread apart the curved ends 44 of the attached arm members 40 exterior the body member 25, as illustrated in FIG. 1. FIG. 2 illustrates the position of the drive mechanism 50, the attachment ends 42 of the curved arm members 40 and the pin members 46 with the curved arm members 40 wide open.

Figure 3:
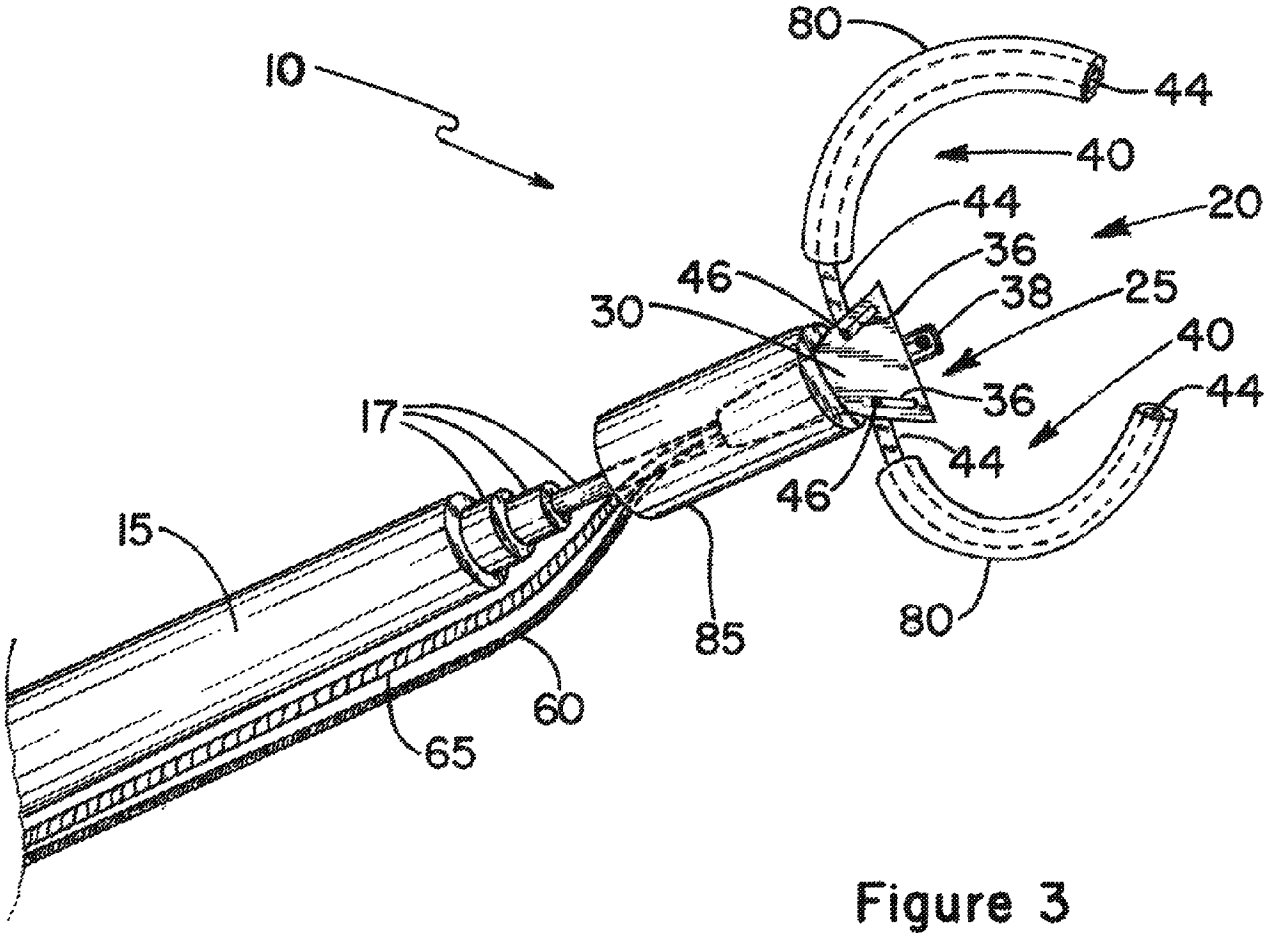
FIG. 3 is a perspective view of the rescue pole with clamping mechanism of the present invention with the clamping mechanism is a closed condition.
Figure 4:
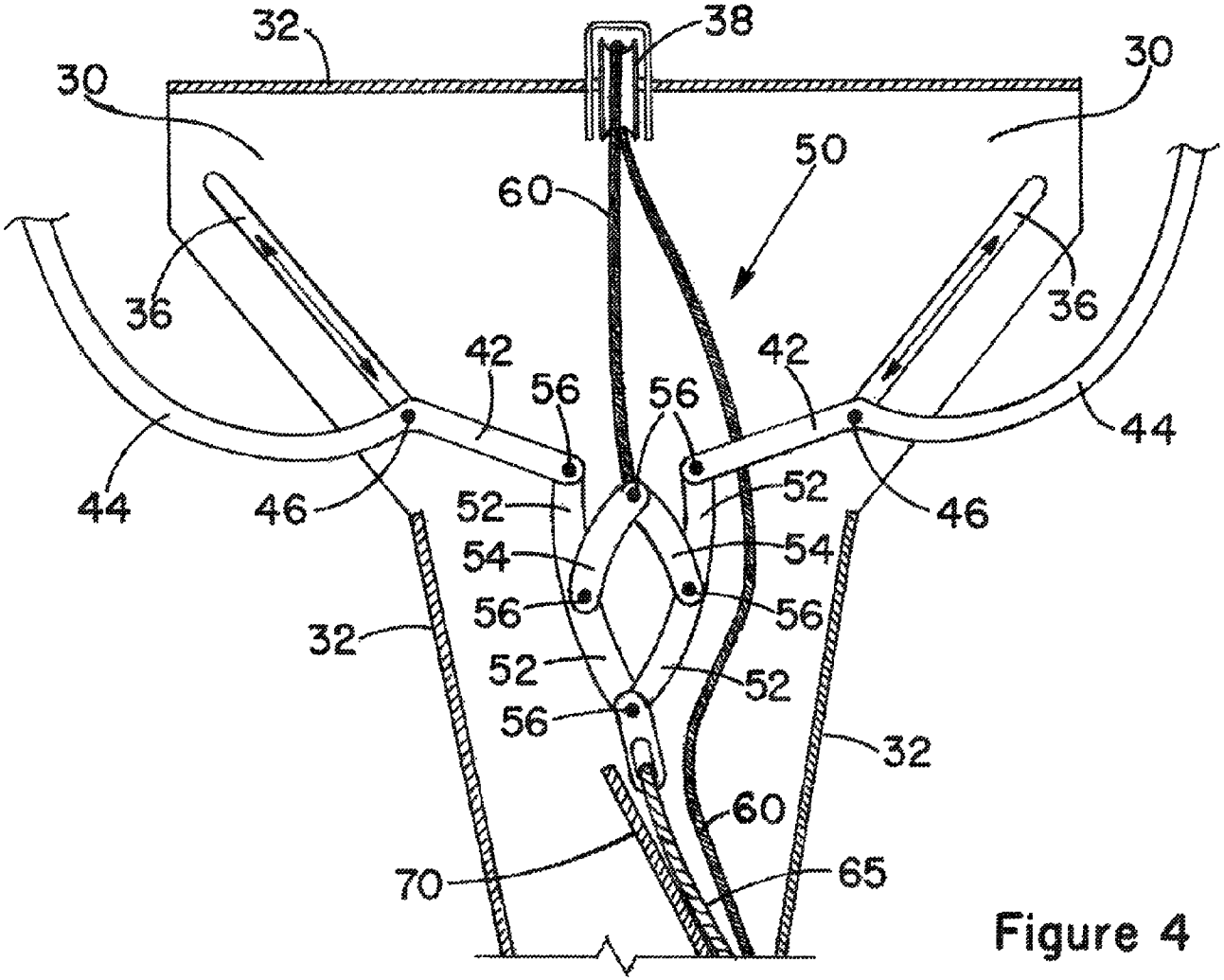
FIG. 4 is a top view of a portion of the clamping mechanism portion of the present invention in a closed condition with one planar portion of the body member removed.

Pulling the second rope member 65 draws the drive mechanism 60 and the attachment end 42 of each arm member 40 toward the pole connector member 34, with the pin members 46 in the linear slots 36 moving to bring together the curved ends 44 of the curved arm members 40 exterior the body member 25, as illustrated in FIG. 3. FIG. 4 illustrates the position of the drive mechanism 50, the attachment ends 42 of the curved arm members 40 and the pin members 46 with the curved arm members 40 tightly closed.

Figure 5:
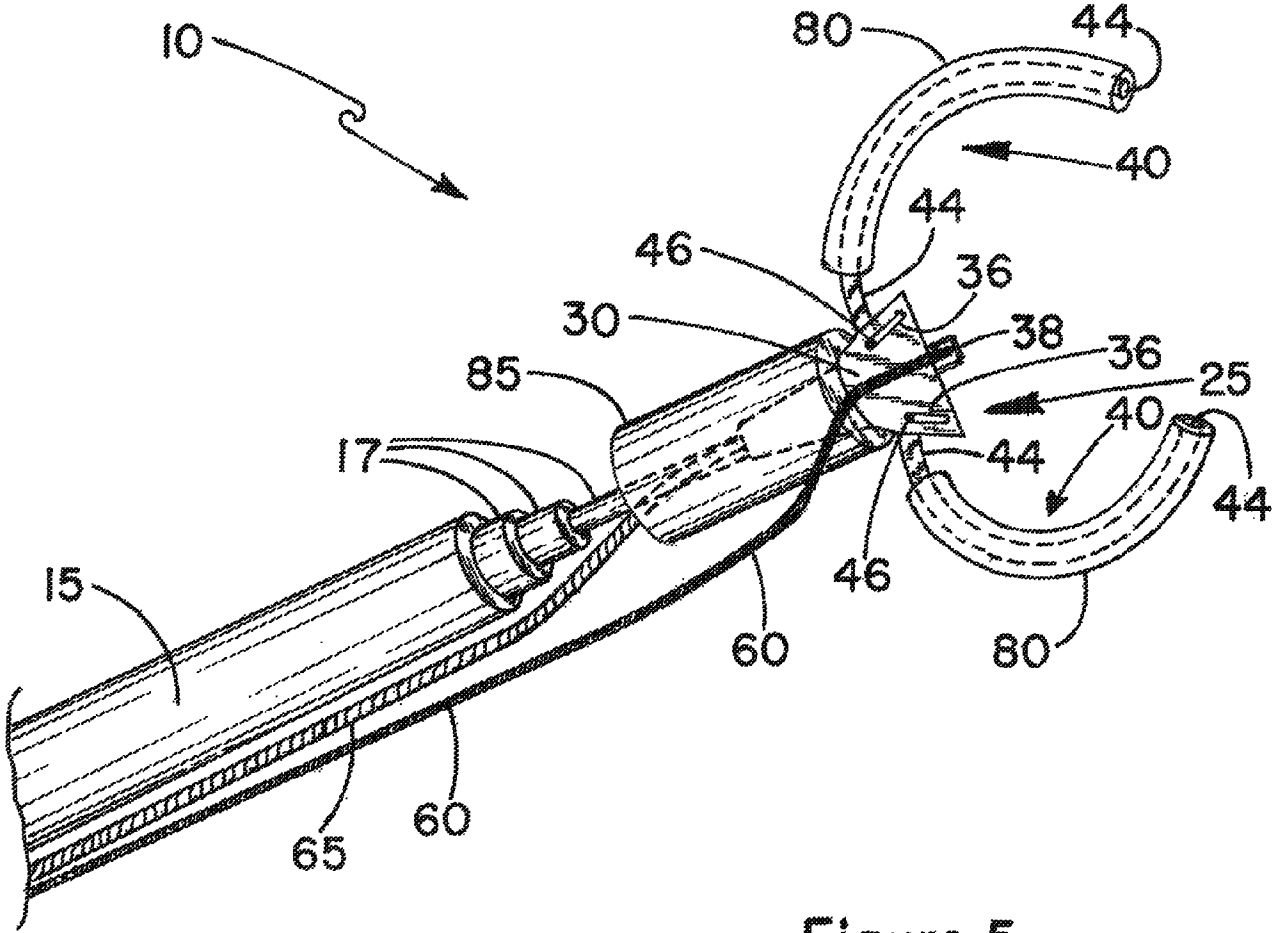
FIG. 5 is a perspective view of the rescue pole with clamping mechanism of the present invention with the clamping mechanism in a closed condition and illustrating an alternative route for the rope to open the clamping mechanism.

The route of the first rope member 60 from the drive mechanism 50 to the end of the linear pole member 15 opposite the clamping mechanism 20 includes two options. As shown in FIGS. 1-4, the first rope member 60 encircles the pulley member 38 and is routed back through the hollow body member 25 and follows the route of the second rope member 65, exiting the hollow body member 25 adjacent the pole connector member 34. An interior partition 70 guides both rope members 60, 65 around the pole connector member 34 to the exterior of the hollow body member 25. Both rope members 60, 65 are routed within the flotation member 85 secured to the body member 25, as illustrated. Alternatively, as shown in FIG. 5, the first rope member 60 encircles the pulley member 38 and then extends exterior the hollow body member 25 and is routed back along the linear pole member 15.

In addition, the first rope member 60 is preferably a smaller diameter rope, since it is used only to spread apart the curved arm members 40 in preparation for engaging an individual with the rescue pole with clamping assembly 10. The second rope member 65 is preferably a larger diameter rope, since it is used to close the curved arm members 40 around the body of an individual. In addition, the second rope member 65 is used, along with the linear pole member 15, to pull the individual to safety, once the rescue pole with clamping assembly 10 firmly engages that individual.

Figure 7:
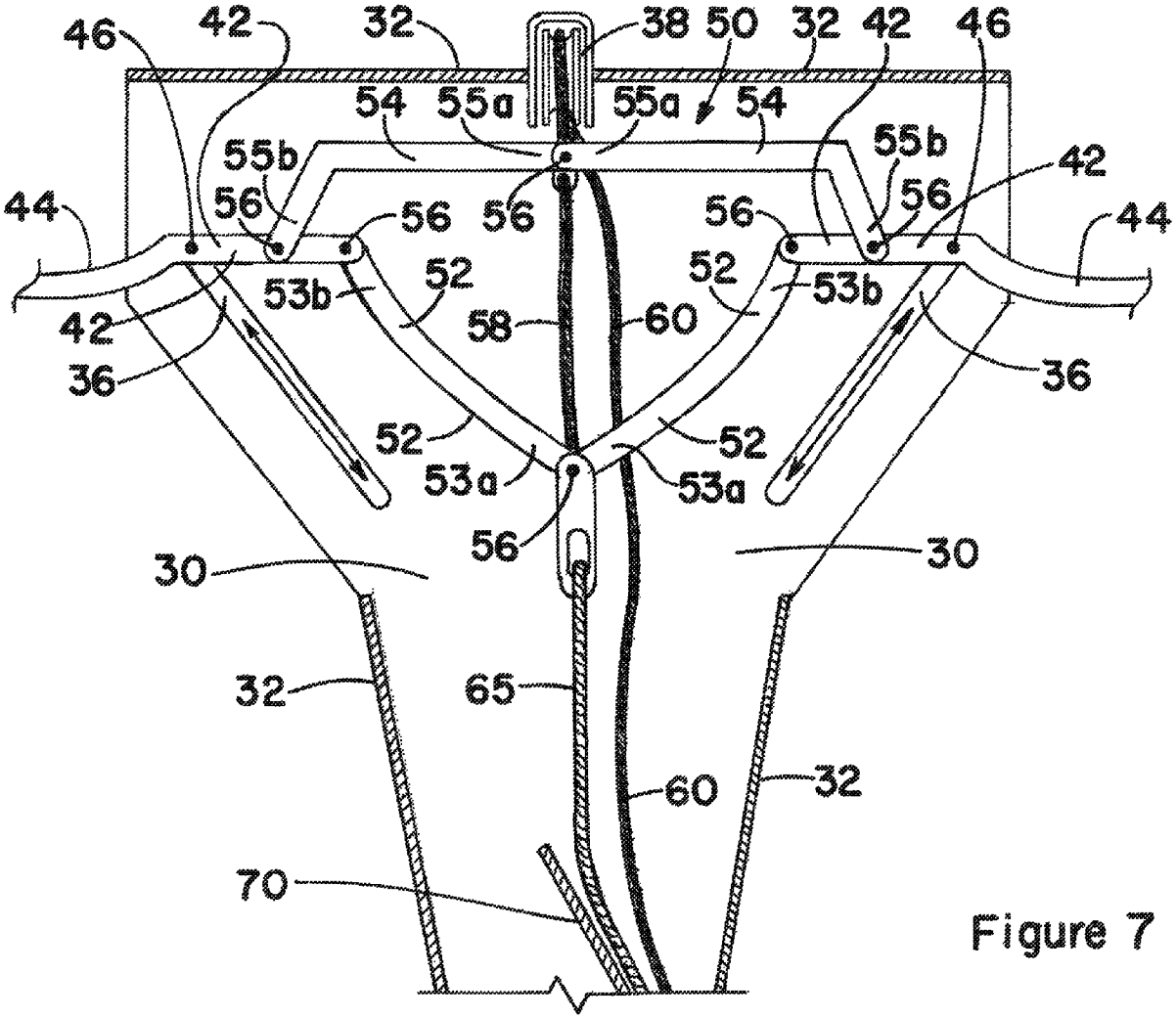
FIG. 7 is a top view of a part of the clamping mechanism portion of the present invention in an open condition with one planar portion of the body member removed.
Figure 8:
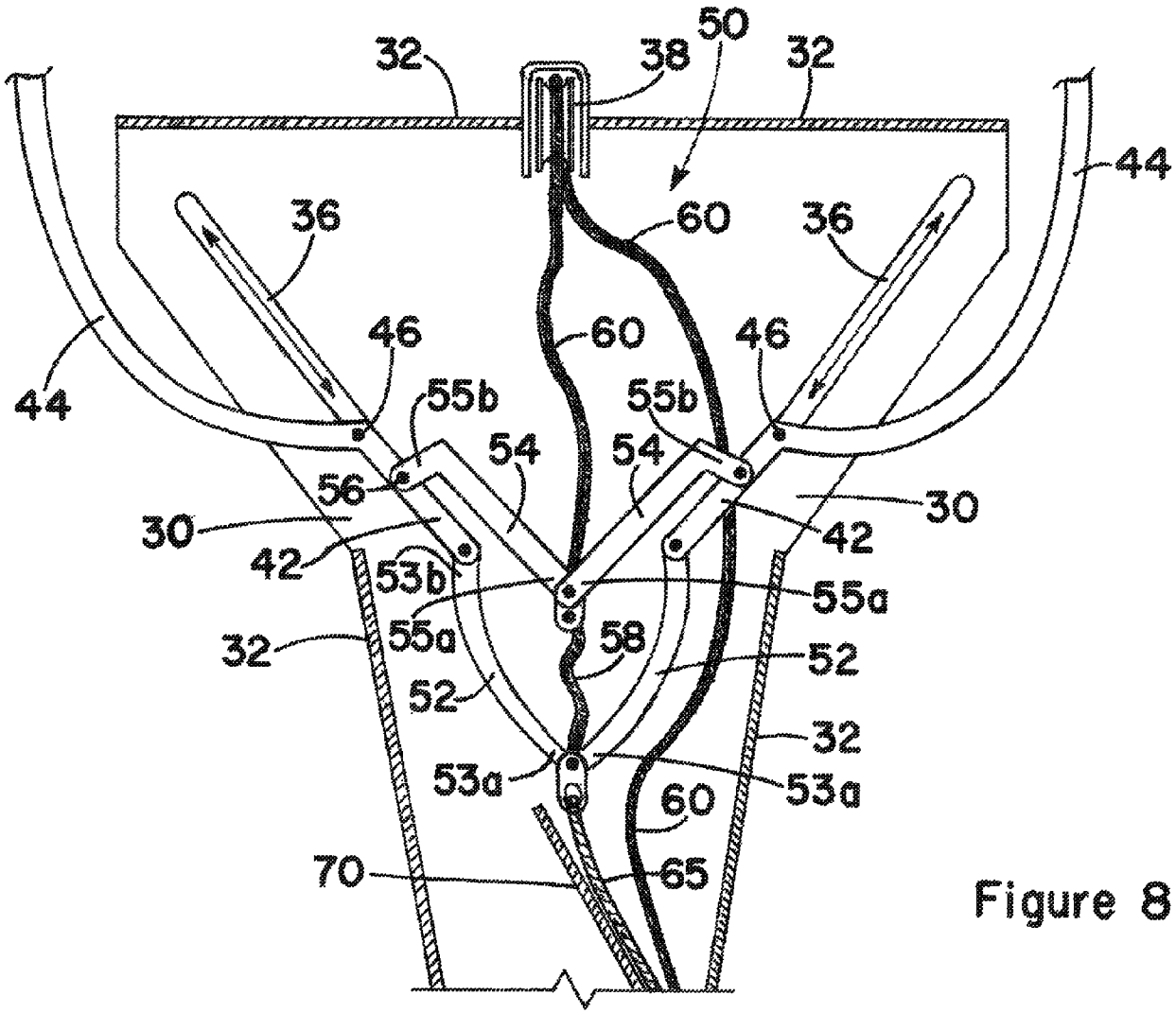
FIG. 8 is a top view of a part of the clamping mechanism portion of the present invention in a closed condition with one planar portion of the body member removed.

Referring now to FIGS. 7 and 8, an alternative embodiment of the drive mechanism 50 is shown. The drive mechanism 50 within the hollow body member 25 is pivotally secured to the attachment end 42 of each curved arm member 40 there within. As shown in FIGS. 7 and 8, the drive mechanism 50 comprises a pair of first pivoting arms 52 pivotally joined together at each first end 53*a* by a pivot point connector pin 56. Each first pivoting arm 52 is pivotally connected at a second end 53*b* to the attachment end 42 of one curved arm member 40 at a point interior to the pin member 46. Another pivot point connector pin 56 provides the connection. In addition, a pair of second pivoting arms 54 is pivotally joined together at each first end 55*a* by another pivot point connector pin 56. Each second pivoting arm 54 is pivotally connected at a second end 55*b* to the attachment end 42 of one curved arm member 40 between the pin member 46 thereof and the pivotally attached first pivoting arm 52. A flexible link 58 is secured between the joined first ends 53*a* of the first pivoting arms 52 and the joined first ends 55*a* of the second pivoting arms 54. The flexible link 58 limits the distance between the connected first ends 53*a* of the first pivoting arms 52 and the connected first ends 55*a* of the second pivoting arms 54 when moving the drive mechanism 50 with either of the attached rope members 60, 65.

A pulley member 38 is rotatably mounted at an edge of the hollow body member 25 opposite the pole connector member 34 and between the pair of opposed curved arm members 40. A first rope member 60 is secured to the drive mechanism 50 at the pivot point connector pin 56 connecting the first ends 55*a* of the pair of second pivoting arms 54. The first rope member 60 encircles the pulley member 38 and extends from the body member 25 adjacent the pole connector member 34 (FIG. 1), or directly from the pulley member 38 (FIG. 5). A second rope member 65 is also secured to the drive mechanism 50, but at the pivot point connector pin 56 connecting the first ends 53*a* of the pair of first pivoting arms 52. The second rope member 65 extends from interior the body member 25 directly from the drive mechanism 50 and outside the body member 25 adjacent the pole connector member 34, as illustrated in FIG. 1.

Pulling the first rope member 60 draws the drive mechanism 50 and the attachment end 42 of each arm member 40 toward the pulley member 38 with the pin members 46 in the linear slots 36 moving to spread apart the curved ends 44 of the attached curved arm members 40 exterior the body member 25, as illustrated in FIG. 1. FIG. 7 illustrates the position of the second embodiment of the drive mechanism 50, the attachment ends 42 of the curved arm members 40 and the pin members 46, with the curved arm members 40 wide open.

Pulling the second rope member 65 draws the drive mechanism 60 and the attachment end 42 of each arm member 40 toward the pole connector member 34, with the pin members 46 in the linear slots 36 moving to bring together the curved ends 44 of the curved arm members 40 exterior the body member 25, as illustrated in FIGS. 3 and 5. FIG. 8 illustrates the position of the second embodiment of the drive mechanism 50, the attachment ends 42 of the curved arm members 40 and the pin members 46, with the curved arm members 40 tightly closed.

Preferably, all components of the clamping mechanism 20 are fabricated from a steel alloy for strength and durability. The linear pole member 15 is preferably fabricated from lighter weight material, such as aluminum, fiberglass or polymeric resin, such as PVC. Such telescoping pole members 15 are commercially available form numerous sources While the invention has been particularly shown and described with reference to preferred embodiments thereof, it will be understood by those skilled in the art that various changes in form and details may be made therein without departing from the spirit and scope of the invention.

I claim:

1. A rescue pole with clamping assembly comprising:

a linear pole member secured at one end to a clamping mechanism;

the clamping mechanism comprising a body member having opposed planar sections in register connected by sidewall sections to form a hollow interior;

a pole connector member positioned at one edge of the body member, the pole connector member attached to said end of the linear pole member;

a pair of opposed curved arm members, with each curved arm member extending from interior the hollow body member, each curved arm member including a pin member positioned interior the hollow body member, each pin member extending through both of a pair of aligned, linear slots in the opposed planar surfaces of the body member, with each pair of aligned slots converging toward the pole connector member;

a drive mechanism within the hollow body member, the drive mechanism pivotally secured to an attachment end of each curved arm member within the hollow body member;

a pulley member rotatably mounted at an edge of the hollow body member opposite the pole connector member and between the pair of opposed curved arm members; and first and second rope members, each secured to the drive mechanism, the first rope member encircling the pulley member and extending from the body member, the second rope member extending from interior the body member directly from the drive mechanism and adjacent the pole connector member;

whereby pulling the first rope member draws the drive mechanism and attachment end of each curved arm member toward the pulley member with the pin members in the linear slots moving to spread apart the attached curved arm members exterior the body member, and pulling the second rope member draws the drive mechanism and attachment end of each curved arm member toward the pole connector member, with the pin members in the linear slots moving to close together the attached curved arm members exterior the body member.

2. The rescue pole with clamping mechanism of claim 1, further including a flotation member encircling each curved arm member exterior the body member, and a flotation member encircling a portion of the body member adjacent the pole connector member.

3. The rescue pole with clamping mechanism of claim 1, wherein the body member includes an interior partition adjacent the pole connector member guiding the second rope member around the pole connector member.

4. The rescue pole with clamping mechanism of claim 1, wherein the drive mechanism comprises a pair of first arms pivotally joined at each first end, each first arm pivotally connected at a second end to the attachment end of one curved arm member, and a pair of second arms pivotally joined at each first end, each second arm pivotally connected at a second end to a midpoint of one of the pair of first arms.

5. The rescue pole with clamping mechanism of claim 4, wherein the first rope member is secured to the drive mechanism at the joined first ends of the pair of second arms, and the second rope member is secured to the drive mechanism at the joined first ends of the pair of first arms.

6. The rescue pole with clamping mechanism of claim 1, wherein the drive mechanism comprises a pair of first arms pivotally joined at each first end, each first arm pivotally connected at a second end to the attachment end of one curved arm member, and a pair of second arms pivotally joined at each first end, each second arm pivotally connected at a second end to one curved arm member between the pin member thereof and the pivotally attached first arm, and a flexible link secured between the joined first ends of the first arms and the joined first ends of the second arms.

7. The rescue pole with clamping mechanism of claim 6, wherein the first rope member is secured to the drive mechanism at the joined first ends of the pair of second arms, and the second rope member is secured to the drive mechanism at the joined first ends of the pair of first arms.

8. The rescue pole with clamping mechanism of claim 1, wherein the linear pole member includes telescoping sections to lengthened the linear pole member.

9. The rescue pole with clamping mechanism of claim 1, wherein the first rope member extends exterior the body member at the pulley member.

10. The rescue pole with clamping mechanism of claim 1, wherein the first rope member extends exterior the body member adjacent the pole connector member.

11. A rescue pole with clamping assembly comprising:

a linear pole member secured at one end to a clamping mechanism;

the clamping mechanism comprising a body member having opposed planar sections in register connected by sidewall sections to form a hollow interior;

a pole connector member positioned at one edge of the body member, the pole connector member attached to said end of the linear pole member;

a pair of opposed curved arm members, with each curved arm member extending from interior the hollow body member, each curved arm member including a pin member positioned interior the hollow body member, each pin member extending through both of a pair of aligned, linear slots in the opposed planar surfaces of the body member, with each pair of aligned slots converging toward the pole connector member;

a flotation member encircling each curved arm member exterior the body member and a flotation member encircling a portion of the body member adjacent the pole connector member;

a drive mechanism within the hollow body member, the drive mechanism pivotally secured to an attachment end of each curved arm member within the hollow body member;

a pulley member rotatably mounted at an edge of the hollow body member opposite the pole connector member and between the pair of opposed curved arm members; and first and second rope members, each secured to the drive mechanism, the first rope member encircling the pulley member and extending from the body member, the second rope member extending from interior the body member directly from the drive mechanism and adjacent the pole connector member;

whereby pulling the first rope member draws the drive mechanism and attachment end of each curved arm member toward the pulley member with the pin members in the linear slots moving to spread apart the attached arm members exterior the body member, and pulling the second rope member draws the drive mechanism and attachment end of each curved arm member toward the pole connector member, with the pin members in the linear slots moving to close together the attached arm members exterior the body member.

12. The rescue pole with clamping mechanism of claim 11, wherein the body member includes an interior partition adjacent the pole connector member guiding the second rope member around the pole connector member.

13. The rescue pole with clamping mechanism of claim 11, wherein the drive mechanism comprises a pair of first arms pivotally joined at each first end, each first arm pivotally connected at a second end to the attachment end of one curved arm member, and a pair of second arms pivotally joined at each first end, each second arm pivotally connected at a second end to a midpoint of one of the pair of first arms.

14. The rescue pole with clamping mechanism of claim 13, wherein the first rope member is secured to the drive mechanism at the joined first ends of the pair of second arms, and the second rope member is secured to the drive mechanism at the joined first ends of the pair of first arms.

15. The rescue pole with clamping mechanism of claim 11, wherein the drive mechanism comprises a pair of first arms pivotally joined at each first end, each first arm pivotally connected at a second end to the attachment end of one curved arm member, and a pair of second arms pivotally joined at each first end, each second arm pivotally connected at a second end to one curved arm member between the pin member thereof and the pivotally attached first arm, and a flexible link secured between the joined first ends of the first arms and the joined first ends of the second arms.

16. The rescue pole with clamping mechanism of claim 15, wherein the first rope member is secured to the drive mechanism at the joined first ends of the pair of second arms, and the second rope member is secured to the drive mechanism at the joined first ends of the pair of first arms.

17. The rescue pole with clamping mechanism of claim 11, wherein the linear pole member includes telescoping sections to lengthened the linear pole member.

18. The rescue pole with clamping mechanism of claim 11, wherein the first rope member extends exterior the body member at the pulley member.

19. The rescue pole with clamping mechanism of claim 11, wherein the first rope member extends exterior the body member adjacent the pole connector member.

20. A rescue pole with clamping assembly comprising:

a linear pole member with telescoping sections, the pole member secured at one end to a clamping mechanism;

the clamping mechanism comprising a body member having opposed planar sections in register connected by sidewall sections to form a hollow interior;

a pole connector member positioned at one edge of the body member, the pole connector member attached to said end of the linear pole member;

a pair of opposed curved arm members, with each curved arm member extending from interior the hollow body member, each curved arm member including a pin member positioned interior the hollow body member, each pin member extending through both of a pair of aligned, linear slots in the opposed planar surfaces of the body member, with each pair of aligned slots converging toward the pole connector member;

a flotation member encircling each curved arm member exterior the body member and a flotation member encircling a portion of the body member adjacent the pole connector member;

a drive mechanism within the hollow body member, the drive mechanism pivotally secured to an attachment end of each curved arm member within the hollow body member;

the drive mechanism comprising a pair of first arms pivotally joined at each first end, each first arm pivotally connected at a second end to the attachment end of one curved arm member, and a pair of second arms pivotally joined at each first end, each second arm pivotally connected at a second end to one curved arm member between the pin member thereof and the pivotally attached first arm, and a flexible link secured between the joined first ends of the first arms and the joined first ends of the second arms;

a pulley member rotatably mounted at an edge of the hollow body member opposite the pole connector member and between the pair of opposed curved arm members;

first and second rope members, each secured to the drive mechanism, the first rope member secured to the drive mechanism at the joined first ends of the pair of second arms, the first rope member encircling the pulley member and extending from the body member at the pulley member, the second rope member secured to the drive mechanism at the joined first ends of the pair of first arms, the second rope member extending from interior the body member directly from the drive mechanism and adjacent the pole connector member; and a partition interior the body member adjacent the pole connector member guiding the second rope member around the pole connector member;

whereby pulling the first rope member draws the drive mechanism and attachment end of each curved arm member toward the pulley member with the pin members in the linear slots moving to spread apart the attached arm members exterior the body member, and pulling the second rope member draws the drive mechanism and attachment end of each curved arm member toward the pole connector member, with the pin members in the linear slots moving to close together the attached arm members exterior the body member.

* * * * *